US010842278B2

(12) United States Patent
Ogg

(10) Patent No.: US 10,842,278 B2
(45) Date of Patent: Nov. 24, 2020

(54) FOLDING CHAIR AND METHOD OF ASSEMBLY

(71) Applicant: Ogg Design, Inc., Littlestown, PA (US)

(72) Inventor: Richard Ogg, Littlestown, PA (US)

(73) Assignee: OGG Design, Inc., Littlestown, PA (US)

( * ) Notice: Subject to any disclaimer, the term of this patent is extended or adjusted under 35 U.S.C. 154(b) by 0 days.

(21) Appl. No.: 16/536,421

(22) Filed: Aug. 9, 2019

(65) Prior Publication Data

US 2020/0046122 A1 Feb. 13, 2020

Related U.S. Application Data

(60) Provisional application No. 62/717,401, filed on Aug. 10, 2018.

(51) Int. Cl.

| | |
|---|---|
| ***A47C 4/04*** | (2006.01) |
| ***A47C 4/14*** | (2006.01) |
| ***A47C 4/24*** | (2006.01) |

(52) U.S. Cl.

CPC ..... *A47C 4/24* (2013.01); *A47C 4/04* (2013.01); *A47C 4/14* (2013.01)

(58) Field of Classification Search

CPC .... A47C 4/04; A47C 4/14; A47C 4/24; A47C 4/025

USPC ..... 297/23, 57

See application file for complete search history.

(56) References Cited

U.S. PATENT DOCUMENTS

| | | | | | |
|---|---|---|---|---|---|
| 105,253 | A * | 7/1870 | Rodgers | A47C 4/24 | 297/57 |
| 479,355 | A * | 7/1892 | Eldridge | A47C 4/24 | 297/57 |
| 1,557,108 | A * | 10/1925 | Tucker | A47C 4/14 | 297/50 |
| 1,704,712 | A * | 3/1929 | Silverman | A47C 4/06 | 248/432 |
| 1,800,107 | A * | 4/1931 | Schmitt | A47C 4/24 | 297/57 |
| 1,873,768 | A * | 8/1932 | Kux | A47C 4/06 | 297/56 |

(Continued)

FOREIGN PATENT DOCUMENTS

| | | | | |
|---|---|---|---|---|
| DE | 923267 C * | 2/1955 | A47C 4/14 |
| DE | 10229737 A1 * | 4/2003 | A47C 4/04 |

(Continued)

*Primary Examiner* — Robert Canfield

(74) *Attorney, Agent, or Firm* — William C. Schrot; Jeffrey I. Auerbach; AuerbachSchrot LLC

(57) ABSTRACT

A folding chair comprises a front leg assembly having spaced inner rail members, a rear leg assembly, and a seat assembly. The rear leg assembly comprises spaced legs pivotally connected to the inner rail members about a first pivot axis, which is substantially coplanar with the longitudinal axes of the inner rail members. The seat assembly comprises spaced arms having distal ends pivotally connected to upper ends of the legs about a second pivot axis, and central portions pivotally connected to the inner rails about a third pivot axis substantially coplanar with the first pivot axis. The third pivot axis is moveable along the longitudinal axes of the inner rail members and toward and away from the first pivot axis as the chair is reconfigured between its deployed and folded orientations.

20 Claims, 13 Drawing Sheets

(56) References Cited

U.S. PATENT DOCUMENTS

| | | | | |
|---|---|---|---|---|
| 1,910,539 | A * | 5/1933 | Hambrook | A47C 4/24 248/432 |
| 1,943,058 | A | 1/1934 | Clarin | |
| 1,949,492 | A * | 3/1934 | Schermerhorn | A47C 4/24 297/57 |
| 2,272,307 | A | 2/1942 | Merrill | |
| 8,651,567 | B2 | 2/2014 | Aldred | |
| 8,794,703 | B2 | 8/2014 | Bateman et al. | |
| 8,851,561 | B2 | 10/2014 | Huang | |
| 8,882,188 | B2 | 11/2014 | Jin | |
| 8,979,185 | B1 | 3/2015 | Redel | |
| 9,033,410 | B2 | 5/2015 | Roani et al. | |
| 9,179,778 | B2 | 11/2015 | Frankel et al. | |
| 9,192,235 | B2 | 11/2015 | Horowitz | |
| 9,237,810 | B2 | 1/2016 | Voris | |
| 9,345,329 | B2 | 5/2016 | Gendell | |
| 9,538,840 | B2 | 1/2017 | Yang | |
| 9,622,583 | B1 | 4/2017 | Lv | |
| 9,737,147 | B2 | 8/2017 | Shadley | |
| 9,867,466 | B2 | 1/2018 | Lovely, II | |
| 9,913,537 | B2 | 3/2018 | Piretti | |
| 9,974,388 | B1 | 5/2018 | Lv | |
| 10,064,491 | B2 | 9/2018 | Piretti | |
| 10,104,971 | B1 | 10/2018 | Yang | |
| 10,136,729 | B2 | 11/2018 | Lin | |
| 10,206,510 | B2 | 2/2019 | Choi | |
| 10,278,506 | B2 | 5/2019 | Yang | |
| 2003/0234562 | A1 | 12/2003 | Huang | |
| 2014/0049077 | A1 | 2/2014 | Jin | |
| 2015/0201759 | A1 | 7/2015 | Winters et al. | |
| 2018/0027970 | A1 | 2/2018 | Frankel et al. | |
| 2018/0132619 | A1 | 5/2018 | Lovely, II | |
| 2018/0249837 | A1 | 9/2018 | Cohen | |
| 2019/0090641 | A1 | 3/2019 | Frankel et al. | |
| 2019/0216222 | A1 | 7/2019 | Winterhalter et al. | |

FOREIGN PATENT DOCUMENTS

| | | | | |
|---|---|---|---|---|
| DE | 202011108494 U1 * | 3/2013 | | A47C 4/04 |
| EP | 3095354 | 3/2018 | | |
| EP | 3189751 | 7/2018 | | |
| EP | 3430947 | 1/2019 | | |
| FR | 1437306 A * | 4/1966 | | A47C 4/14 |
| FR | 1567943 A * | 5/1969 | | A47C 4/14 |
| FR | 2574642 A1 * | 6/1986 | | A47C 4/14 |
| GB | 318354 A * | 9/1929 | | A47C 4/30 |
| JP | 3162314 U * | 8/2010 | | A47C 5/10 |
| WO | WO 2015/109268 | 7/2015 | | |
| WO | WO 2019/140397 | 7/2019 | | |

* cited by examiner

FOLDING CHAIR AND METHOD OF ASSEMBLY

CROSS-REFERENCE TO RELATED APPLICATIONS

This application is based on U.S. Provisional Patent Application Ser. No. 62/717,401, filed Aug. 10, 2018, which application is incorporated herein by reference in its entirety and to which priority is claimed.

FIELD OF THE INVENTION

The present invention relates to a folding chair reconfigurable from a deployed orientation to a folded orientation having substantially flat opposing major faces, and to a method of assembling the folding chair.

BACKGROUND OF THE INVENTION

Numerous designs for folding chairs have been developed. In many designs (see, e.g., U.S. Pat. Nos. 9,033,410; 9,737,147), frame members are pivotably connected to each other in an X-shape, and foldable between an open and a closed or folded position. A backrest and seat are provided, which may be formed from a flexible fabric material spanning between and supported by the frame members.

In some designs (see, e.g., EP 3095354; EP 3189751; EP 3430947; U.S. Pat. Nos. 8,979,185; 9,179,778; 9,913,537; U.S. Ser. No. 10/064,491), a folding chair includes support members pivotable about an axis between an open position and a closed position. A backrest and seat are secured to and supported by the support members. The backrest is fixedly secured to the frame members. The seat is pivotable about a fixed axis between an open position and a closed position. In some designs (see U.S. Pat. No. 8,851,561), the seat may be locked in place via pins, such as spring loaded pins that are depressed in order to pivot the seat into the closed position.

In another design (see, e.g., U.S. Pat. No. 8,651,567), a folding chair includes a rear support frame carrying a backrest, and a front support frame. A seat is hingedly connected to the front support member, and foldable between a closed position against the backrest and an open position. The rear and front support members are attached via hinged or scissor-like support members. In another design (see, e.g., U.S. Pat. No. 8,794,703), a folding chair includes a front support member carrying a backrest, and a rear support frame. A seat is hingedly connected to both the front and rear support members. A pair of hinge links cooperate with the seat and interconnect the front and rear support frames, and allow the support members and seat to fold between a closed position and an open position.

In another design (see, e.g., U.S. Pat. No. 8,882,188), a folding chair includes front and rear leg frames forming a X-shape, and a backrest pivotably connected to a seat. Support braces are provided, which are pivotably connected to the backrest frame and the front leg frame. In an open position, the backrest frame is upright and perpendicular to the seat, and in the closed position the seat is folded against the backrest frame. In another design (see, e.g., U.S. Pat. No. 9,237,810), a folding chair includes a frame having a backrest, a seat hingedly connected to the frame, and left and right legs pivotably connected to the frame. In the closed position, the seat is folded upwardly against the backrest, and the legs are folded inwardly against the frame.

In other designs (see, e.g., U.S. Pat. Nos. 9,192,235; 9,538,840; 9,622,583; 9,867,466; 9,974,388; U.S. Ser. Nos. 10/104,971; 10/206,510), a folding chair includes a plurality of tubular frame members hingedly connected to each other. The frame members may be folded inwardly to a compressed or storage position and outwardly to an open position. Flexible material is secured to the frame members and forms a seat and backrest. In some designs, the frame members include arm rests that also flex between compressed and open positions.

While prior designs for folding chairs provide some advantages, they are still overly bulky particularly when folded. Moreover, prior designs fail to fold into a substantially flat configuration, and therefore require extensive space for storage even when folded. In addition, many prior designs are overly complex to manufacture and assemble, including numerous linkages and other components, and thus are time consuming and expensive to manufacture and/or repair. Further, many prior designs are not aesthetically pleasing to most consumers, and therefore are not commercially viable and/or lack suitability for many applications.

Accordingly, there is a need for a folding chair that solves some or all of the problems and disadvantages associated with prior designs.

SUMMARY OF THE INVENTION

The present invention is directed to a folding chair comprising a front leg assembly, a rear leg assembly, and a seat assembly. The front leg assembly comprises spaced first and second inner rail members. Each of the first and second inner rail members has a longitudinal axis. The rear leg assembly comprises spaced first and second legs. The first and second legs include central portions pivotally connected to the first and second inner rail members, respectively, about a first pivot axis. The first pivot axis is perpendicular to and substantially coplanar with the longitudinal axes of the first and second inner rail members. The seat assembly comprises spaced first and second arms. The first and second arms comprise distal ends pivotally connected to upper ends of the first and second legs, respectively, about a second pivot axis. The first and second arms also include central portions pivotally connected to the first and second inner rails, respectively, about a third pivot axis parallel to and substantially coplanar with the first pivot axis. The third pivot axis is moveable along the longitudinal axes of the first and second inner rail members and toward and away from the first pivot axis as the folding chair is reconfigured between a deployed orientation and a folded orientation. In some implementations, the second pivot axis is parallel to and substantially coplanar with the first pivot axis when the folding chair is disposed in its folded orientation.

In some embodiments, the front leg assembly further comprises an outer frame comprising spaced first and second cover members coupled to the first and second inner rail members, respectively. In some implementations, the spaced first and second cover members comprise channels slidably received over outwardly facing surfaces of the first and second inner rail members, respectively. In some implementations, the outer frame further comprises a back panel coupled to and extending between upper end portions of the first and second cover members.

In some implementations, the outer frame has a generally U-shaped configuration. In some embodiments, the rear leg assembly and the seat assembly collectively have a generally rectangular configuration when the folding chair is disposed in its folded orientation.

In some embodiments, the folding chair comprises a seat panel coupled to and extending between the first and second arms of the seat assembly. In some implementations, the seat panel includes support struts or ribs extending outwardly from an underside of the seat panel, which enhance rigidity and structural integrity of the seat panel. In some implementations, the seat panel includes a cushioned pad or upper surface for enhanced comfort during use.

In some embodiments, the folding chair further comprises a brace coupled to and extending between lower portions of the first and second cover members of the outer frame. In some embodiments, the folding chair alternatively or additionally comprises a brace coupled to and extending between the lower end portions of the left and right inner rail members.

In some implementations, the outer frame defines a front face and an opposite rear face of the folding chair. The second pivot axis is disposed outwardly from the front face when the folding chair is disposed in its deployed orientation. The second pivot axis is disposed in between the front face and the rear face when the folding chair is disposed in its folded orientation.

In some embodiments, each of the first and second inner rail members of the front leg assembly comprises a slot disposed in an upper portion thereof and extending substantially parallel to the longitudinal axes of the first and second inner rail members. The first and second arms of the seat assembly comprise engagement members, such as pins, which extend outwardly from the central portion thereof and are received in and movable along a corresponding one of the slots as the folding chair is reconfigured between the deployed orientation and the folded orientation.

In some embodiments, the folding chair includes a elongate member, such as a rod, coupled to and extending between the first and second arms of the seat assembly. In some implementations, the rod has a longitudinal axis that is axially aligned with the second pivot axis.

The present invention also relates to a method of assembling a folding chair, comprising the steps of: providing a pair of spaced inner rail members each having a longitudinal axis; providing a seat assembly pivotally connected to a pair of rear legs; pivotally connecting the rear legs to the inner rail members about a first pivot axis, wherein the seat assembly is pivotally connected to the rear legs about a second pivot axis spaced from the first pivot axis; pivotally and slidably connecting the seat assembly to the inner rail members about a third pivot axis, wherein the third pivot axis is coplanar with and movable toward and away from the first pivot axis; and coupling a pair of cover members to outwardly disposed surfaces of the inner rail members. In some implementations, the cover members are slidably received over the inner rail members along the longitudinal axes thereof.

DETAILED DESCRIPTION OF EMBODIMENTS OF THE INVENTION

The terms "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 2:
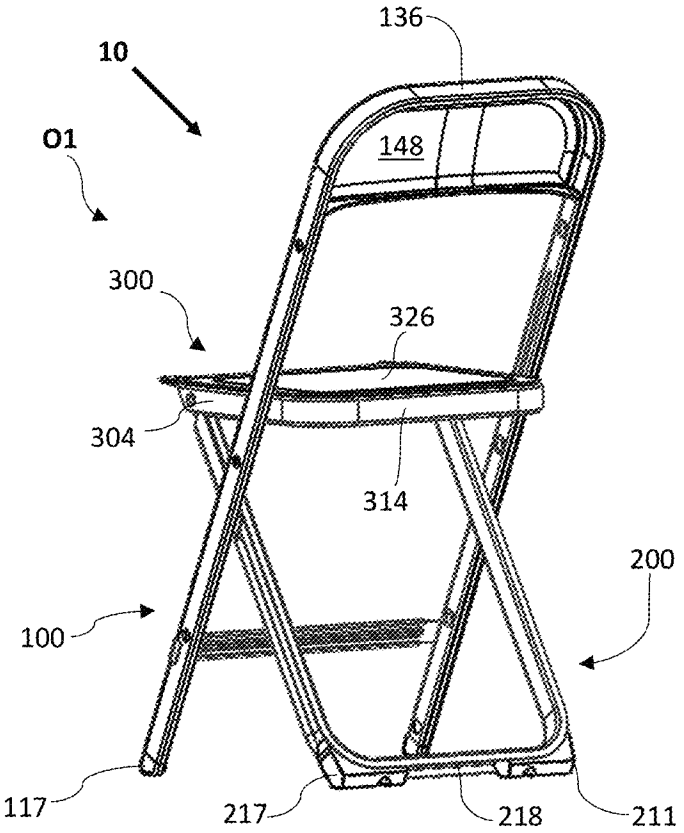
FIG. 2 is rear perspective view of the folding chair in accordance with the present invention and showing the chair in a deployed orientation.
Figure 1:
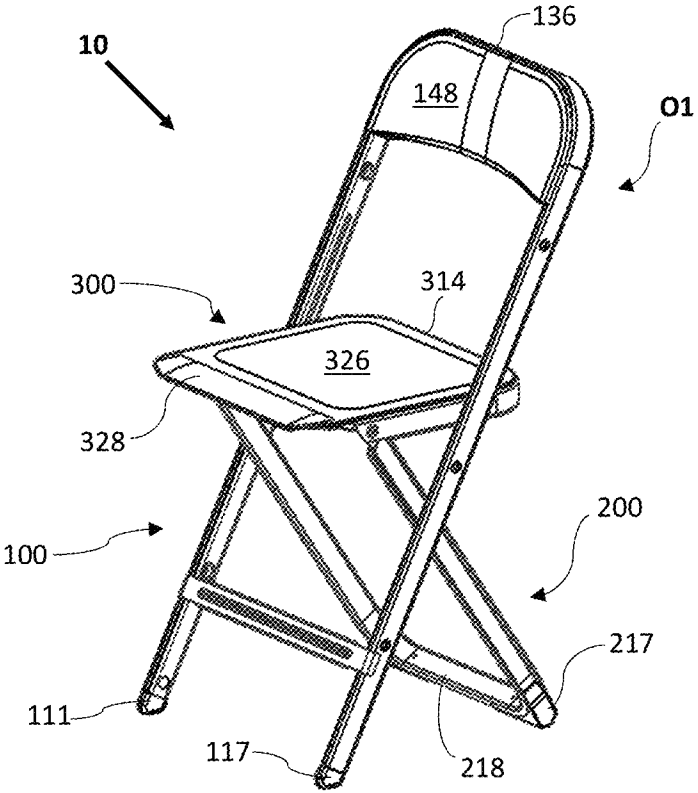
FIG. 1 is a front perspective view of a folding chair in accordance with an embodiment of the present invention, and showing the chair in a deployed orientation.
Figure 4:
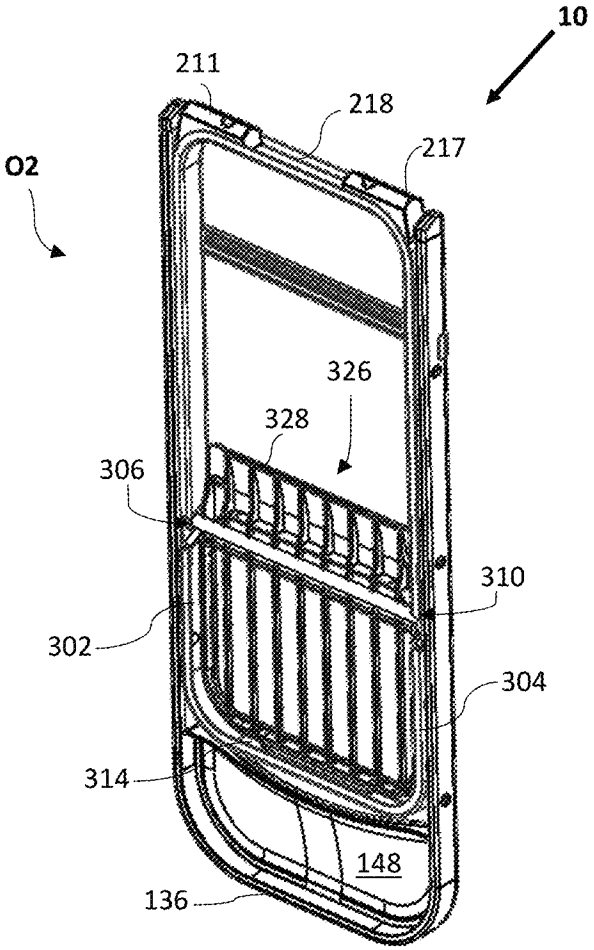
FIG. 4 is a rear perspective view of the folding chair in accordance with the present invention and showing the chair in a folded orientation.
Figure 3:
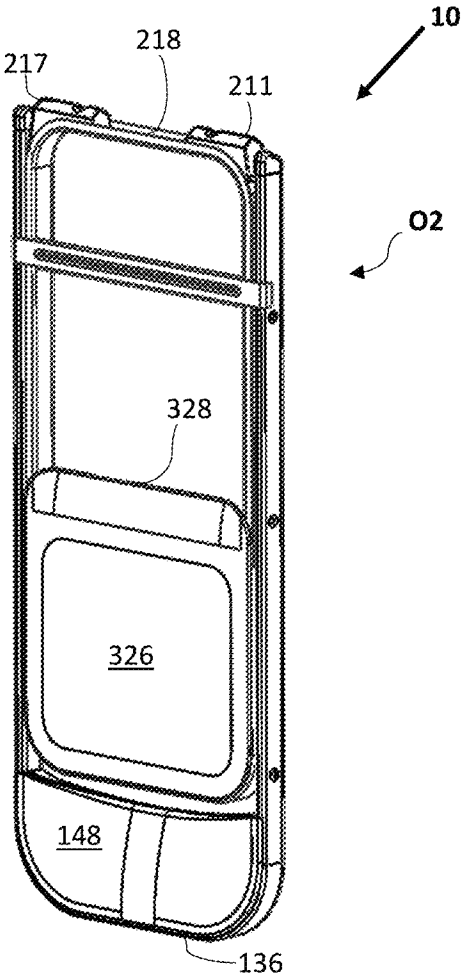
FIG. 3 is a front perspective view of the folding chair in accordance with the present invention and showing the chair in a folded orientation.

A folding chair 10 according to an embodiment of the present invention is illustrated in FIGS. 1-4. The folding chair 10 is reconfigurable between a deployed orientation O1 as shown in FIGS. 1 and 2, and a folded orientation O2 as shown in FIGS. 3 and 4. The chair 10 includes a front leg assembly 100, a rear leg assembly 200, and a seat assembly 300.

Figure 5:
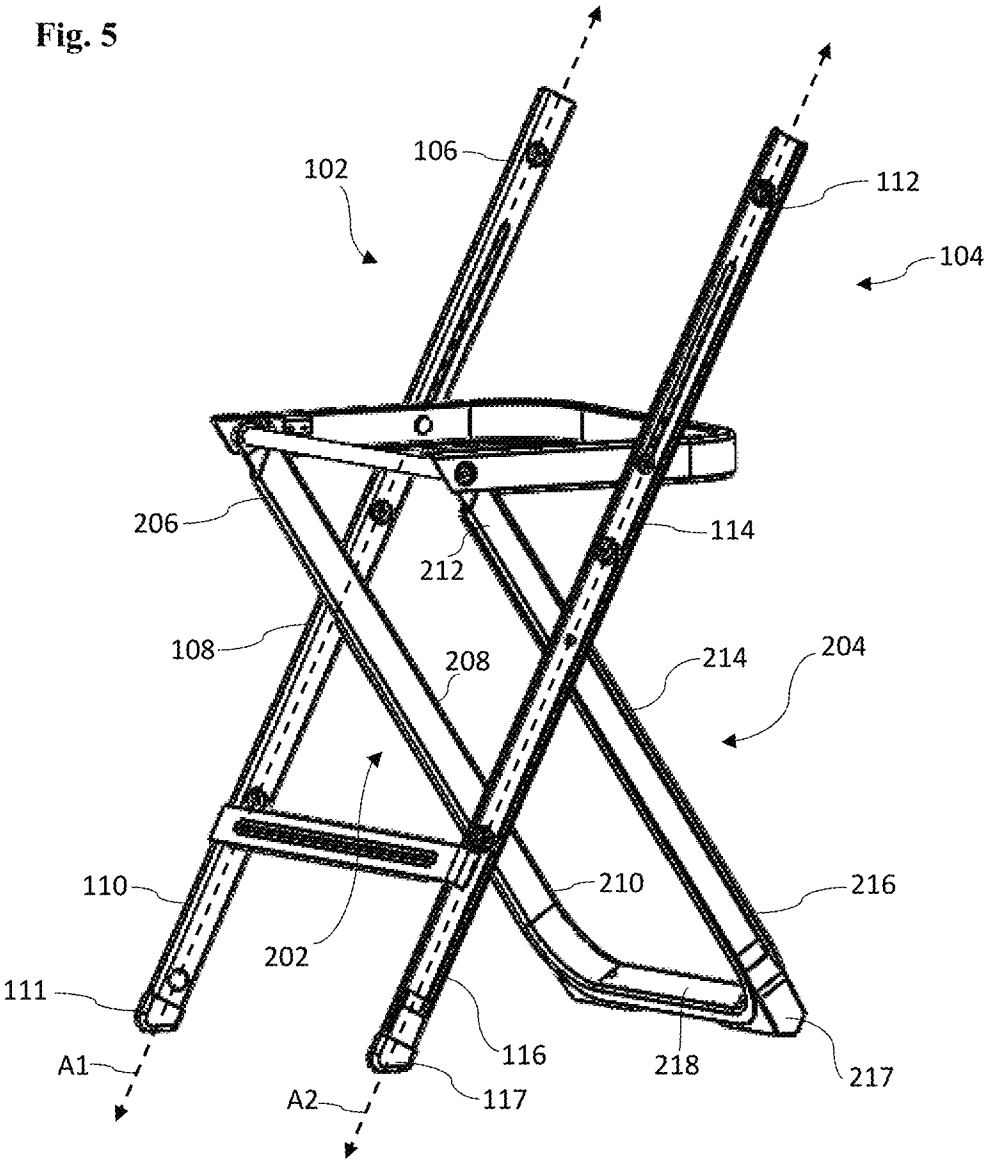
FIG. 5 is a perspective view of components of the folding chair in accordance with the present invention.
Figure 6:
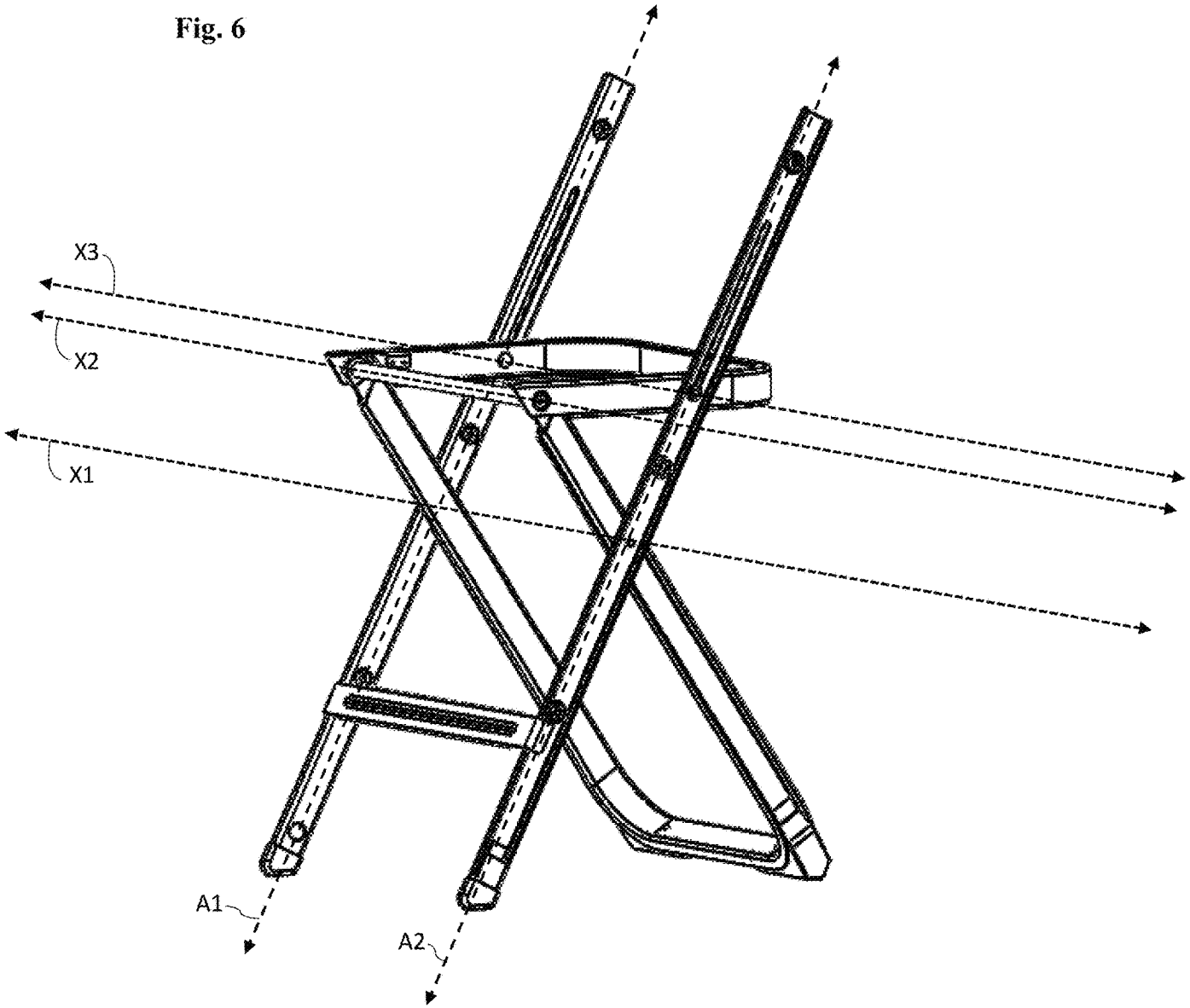
FIG. 6 is another perspective view of components of the folding chair in accordance with the present invention, and showing pivot axes and longitudinal axes of the inner rail members.
Figure 7:
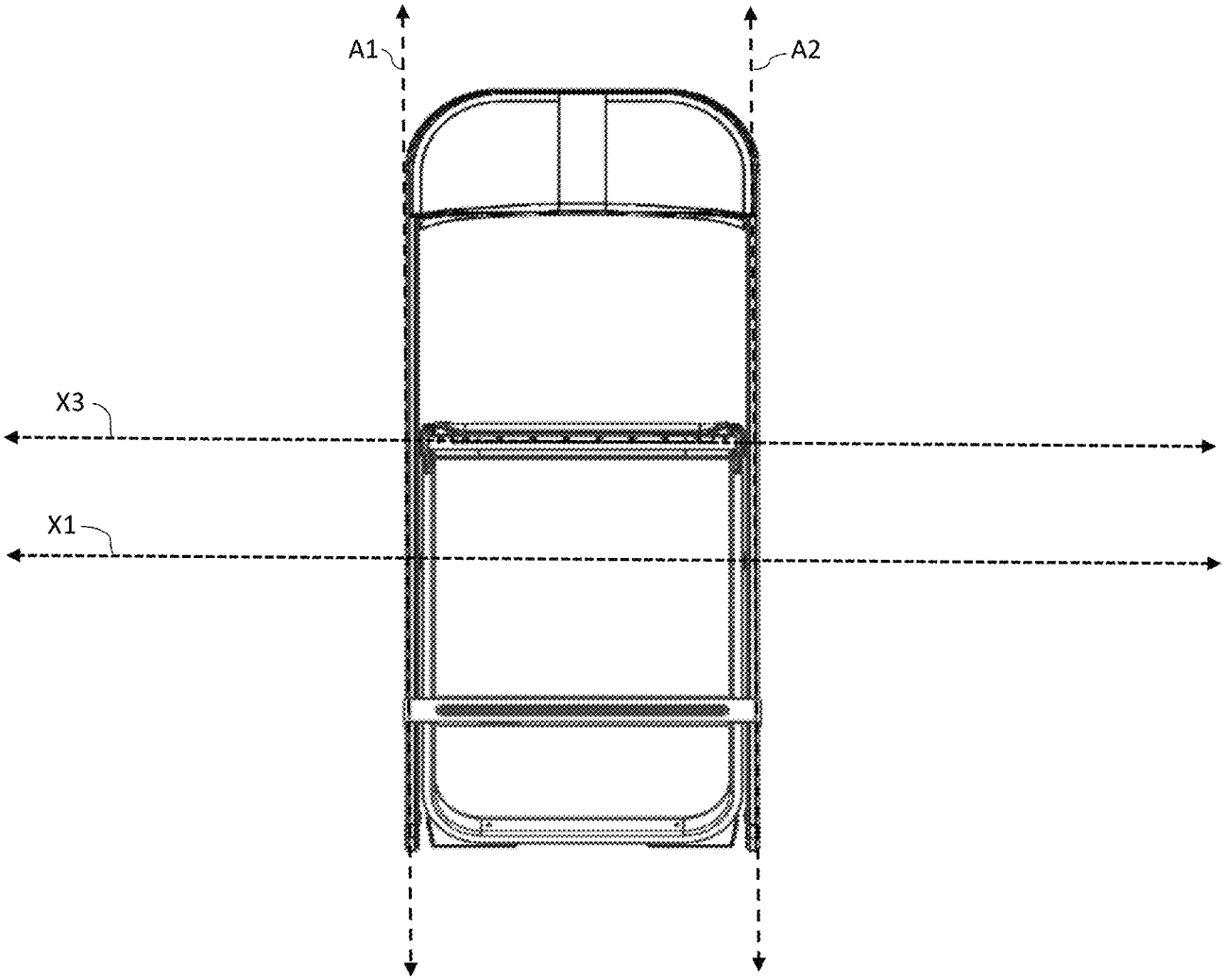
FIG. 7 is a front view of the folding chair in accordance with the present invention, and showing pivot axes and longitudinal axes of the inner rail members.
Figure 8:
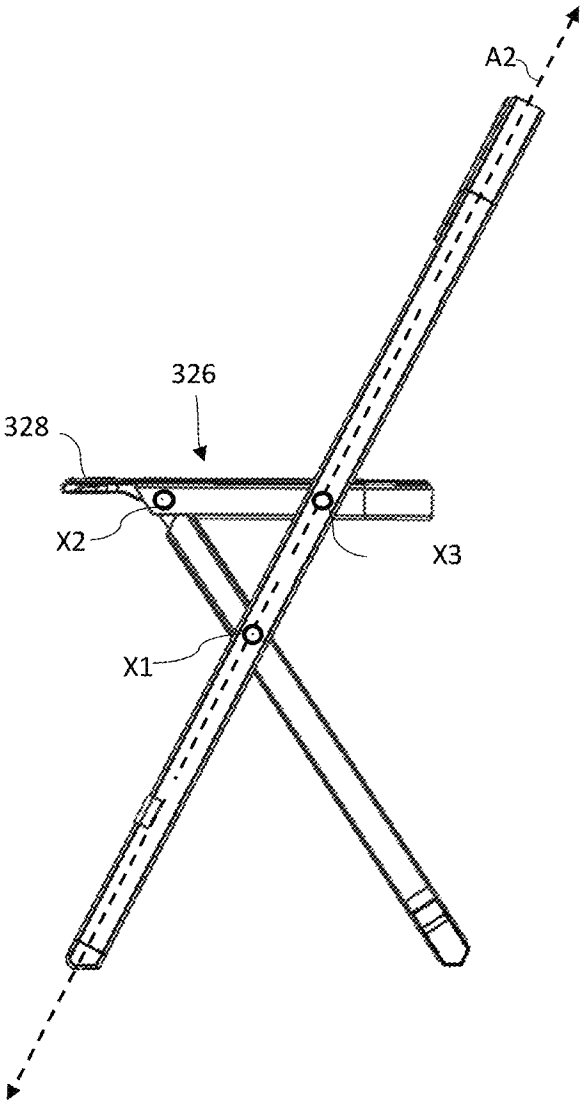
FIG. 8 is a side view of the folding chair in accordance with the present invention, and showing pivot axes and longitudinal axes of the inner rail members.

Referring to FIG. 5, the front leg assembly 100 includes spaced first and second inner rail members 102, 104. The first inner rail member 102 includes an upper portion 106, a central portion 108, and a lower portion 110. Similarly, the second inner rail member 104 includes an upper portion 112, a central portion 114, and a lower portion 116. The first inner rail member 102 has a longitudinal axis A1, and the second inner rail member 104 has a longitudinal axis A2. Inner rail members 102, 104 are positioned so that longitudinal axes A1, A2 thereof are spaced from and parallel to each other.

The rear leg assembly 200 includes spaced first and second legs 202, 204. The first leg 202 comprises a distal upper end 206, a central portion 208, and a lower end portion 210, as shown in FIG. 5. Similarly, the second leg 204 comprises a distal upper end 212, a central portion 214, and a lower end portion 216. Preferably, the rear leg assembly 200 includes a brace or crossbeam 218 coupled to and extending between the lower end portions 210, 216 of the first and second legs 202, 204. The first and second legs 202, 204 and the crossbeam 218 may collectively have a generally U-shaped configuration.

Referring to FIGS. 5-8, the central portion 208 of the first leg 202 is pivotally connected to the central portion 108 of the first inner rail member 102, and the central portion 214 of the second leg 204 is pivotally connected to the central portion 114 of the second inner rail member 104 (see FIG. 5). In this way, the rear leg assembly 200 is pivotally connected to the front leg assembly 100 about a first pivot axis X1 (see FIGS. 6 and 7). The first pivot axis X1 is preferably perpendicular to and substantially coplanar with the longitudinal axes A1, A2 of the inner rail members 102, 104 of the front leg assembly 100 (see FIGS. 6, 7 and 8).

Figure 9:
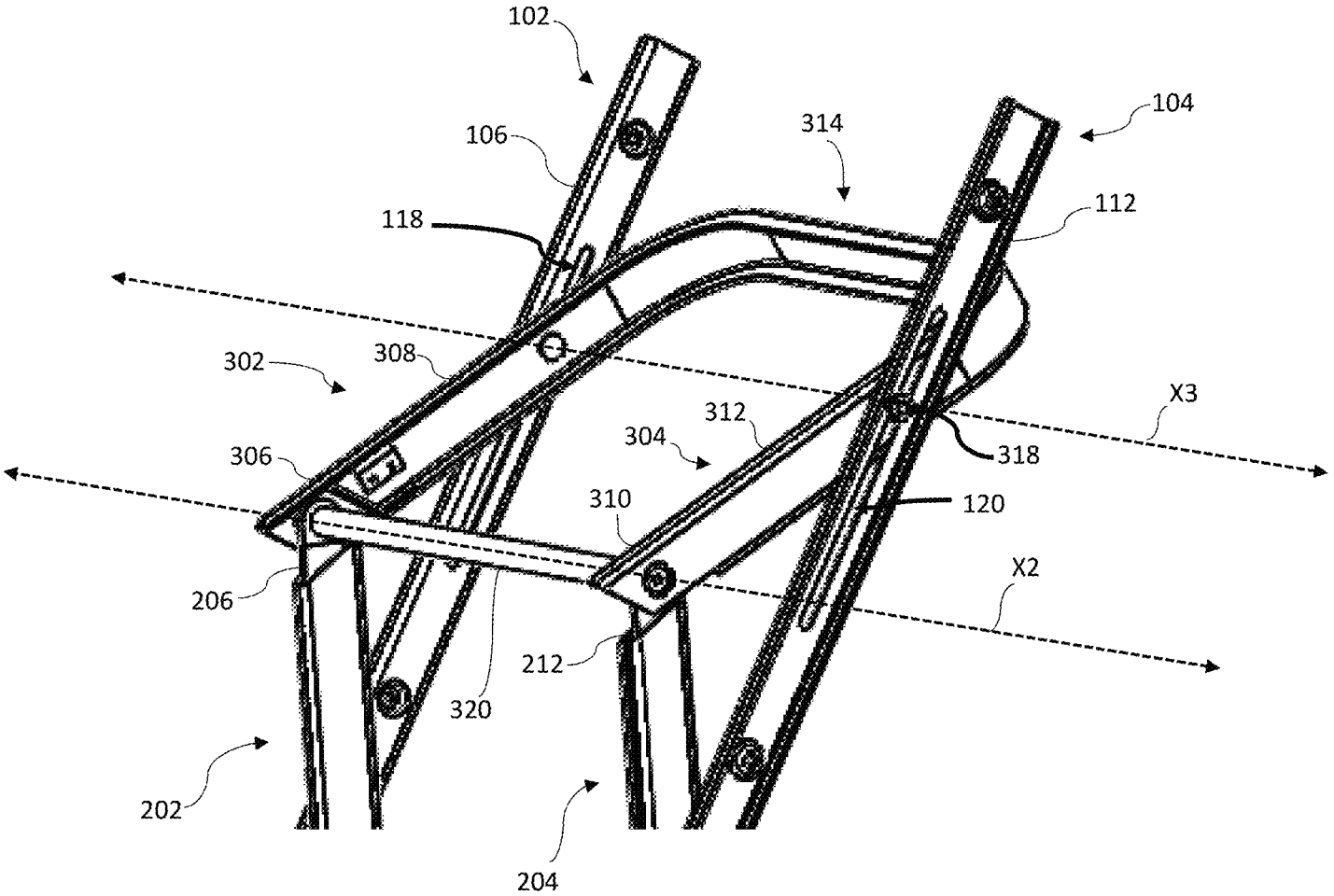
FIG. 9 is a perspective view of components of the folding chair in accordance with the present invention, and showing pivotal and movable connections of the assemblies thereof.
Figure 10:
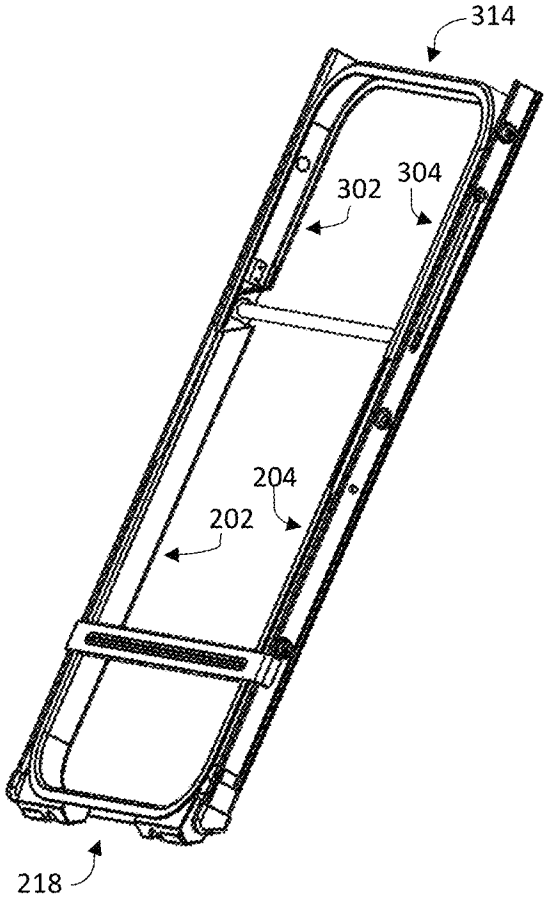
FIG. 10 is another perspective view of components of the folding chair in accordance with the presentation, and showing such components in a folded orientation.

Referring to FIG. 9, the seat assembly 300 includes spaced first and second arms 302, 304. The first arm 302 includes a distal end 306 and a side portion 308, and the second arm 304 includes a distal end 310 and a side portion 312. Preferably, the seat assembly 300 includes a brace or central portion 314 coupled to and extending between the first and second arms 302, 304. The first and second arms 302, 304 and the central portion 314 may collectively have a generally U-shaped configuration. The distal end 306 of the first arm 302 is pivotally connected to the distal upper end 206 of the first leg 202 of the rear leg assembly 200, and the distal end 310 of the second arm 304 is pivotally connected to the distal upper end 212 of the second leg 204 of the rear leg assembly 200. In this way, the seat assembly 300 is pivotally connected to the rear leg assembly 200 about a second pivot axis X2, as shown in FIGS. 6-9. The second pivot axis X2 is preferably perpendicular to the longitudinal axes A1, A2 of the inner rail members 102, 104. In some implementations, the first and second legs 202, 204 and the central portion 214 of the rear leg assembly 200, and the first and second arms 302, 304 and the central portion 314 of the seat assembly 300, collectively have a generally rectangular configuration in plan view when the chair 10 is disposed in its folded orientation O2, as shown in FIG. 10.

Referring again to FIG. 9, the side portion 308 of the first arm 302 is pivotally connected to the upper portion 106 of the first inner rail member 102 of the front leg assembly 100. Similarly, the side portion 312 of the second arm 304 is pivotally connected to the upper portion 112 of the second inner rail member 104 of the front leg assembly 100. Thus, the seat assembly 300 is also pivotally connected to the front leg assembly 100 about a third pivot axis X3, as shown in FIGS. 6-9. The third pivot axis X3 is parallel to and/or substantially coplanar with the first pivot axis X1. Thus, the third pivot axis X3 is perpendicular to and substantially coplanar with the longitudinal axes A1, A2 of the inner rail members 102, 104 of the front leg assembly 100.

In addition, the side portions 308, 312 of the first and second arms 302, 304 are movably coupled to the upper portions 106, 112 of the first and second inner rail members 102, 104, respectively. In one implementation, the upper portion 106 of the first inner rail member 102 defines a slot 118, and the upper portion 112 of the second inner rail member 104 defines another slot 120. The slots 118, 120 are substantially parallel to the longitudinal axes A1, A2 of the first and second inner rail members 102, 104, respectively (see FIGS. 5 and 6). The first arm 302 of the seat assembly 300 includes an engagement member or pin 316 (see FIG. 11) extending outwardly therefrom, and the second arm 304 includes another engagement member or pin 318 extending outwardly therefrom. The pins 316, 318 are received in and movable along the corresponding slots 118, 120, respectively, as the chair 10 is reconfigured between its deployed orientation O1 and folded orientation O2. Thus, the third pivot axis X3 is linearly movable along the longitudinal axes A1, A2 of the first and second inner rail members 102, 104, and in a direction toward the first pivot axis X1 as the chair 10 is reconfigured from folded orientation O2 to its deployed orientation O1, and away from the first pivot axis X1 as the chair 10 is reconfigured from its deployed orientation O1 to its folded orientation O2.

Figure 12:
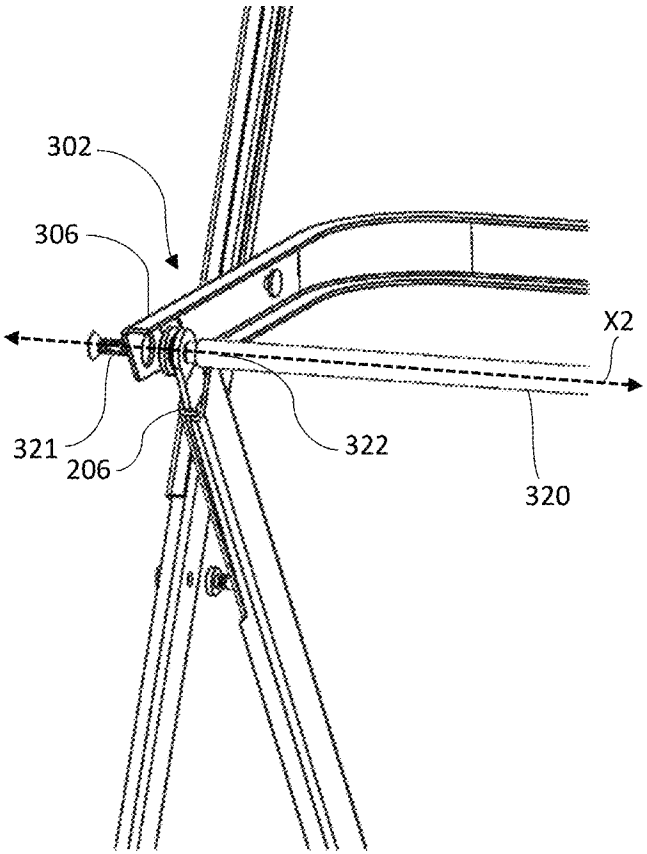
FIG. 12 is front perspective view of components of the folding chair in accordance with the present invention.
Figure 11:
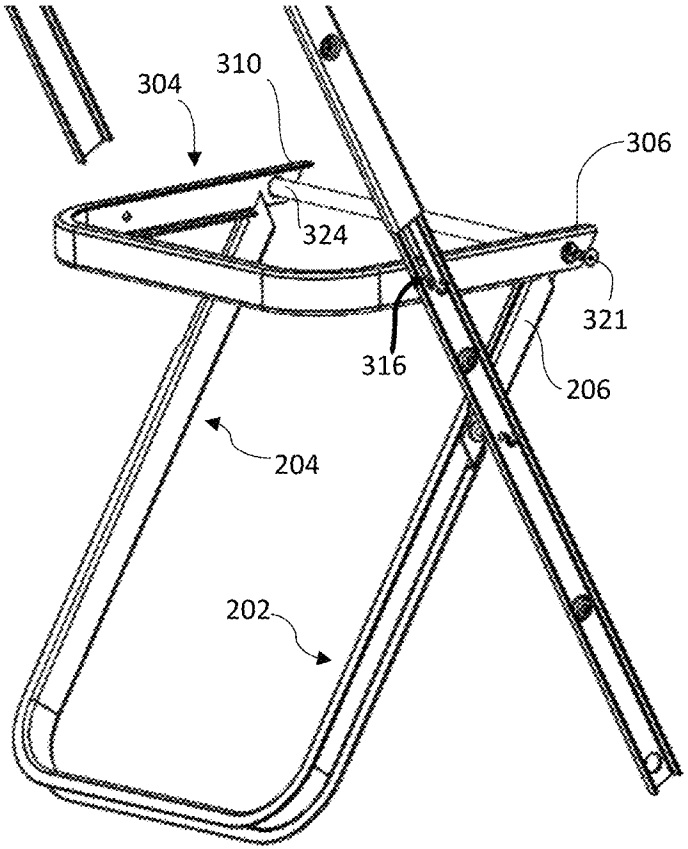
FIG. 11 is rear perspective view of components of the folding chair in accordance with the present invention.

With reference to FIGS. 9, 11 and 12, a support member or rod 320 is coupled to and extends between the first and second arms 302, 304 of the seat assembly 300. Preferably, the rod 320 is coupled to and extends between the distal ends 306, 310 of the first and second arms 302, 304, respectively. The rod 320 is also preferably coupled to and extends between the distal upper ends 206, 212 of the first and second legs 202, 204 of the rear leg assembly 200. The rod 320 aids in the spacing and pivotal coupling of the seat assembly 300 to the rear leg assembly 200. For example, fasteners 321 (e.g., screws, pins, rivets, bolts, etc.) may be inserted through openings in the distal ends 306, 310 of the first and second arms 302, 304, and also through correspondingly aligned openings in the distal upper ends 206, 212 of the first and second legs 202, 204, and secured to opposing ends 322, 324 of the rod 320. In this way, the rear leg assembly 200 is pivotally coupled to the seat assembly 300. Preferably, the longitudinal axis of the rod 320 is axially aligned with the second pivot axis X2.

Figure 14:
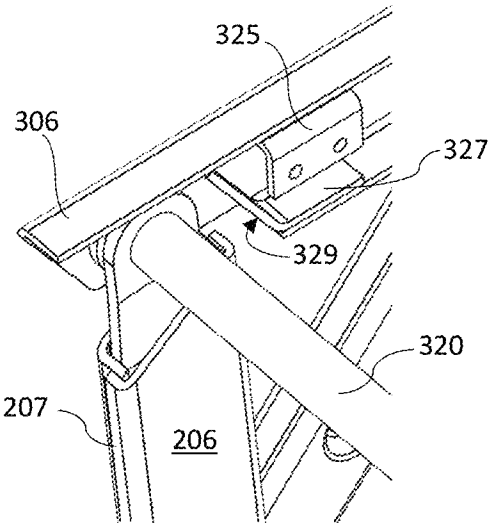
FIG. 14 is another perspective view of components of the folding chair in accordance with the present invention, and showing such components in a partially deployed orientation.
Figure 15:
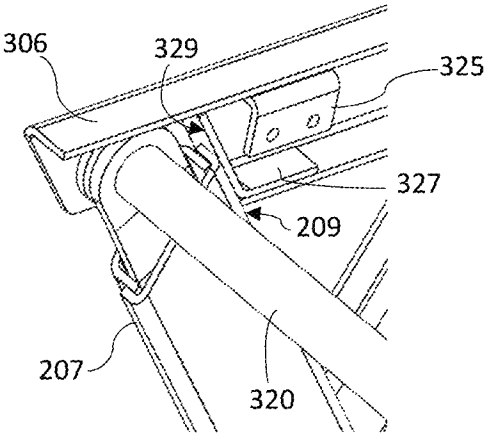
FIG. 15 is another perspective view of components of the folding chair in accordance with the present invention, and showing such components in a fully deployed orientation.
Figure 13:
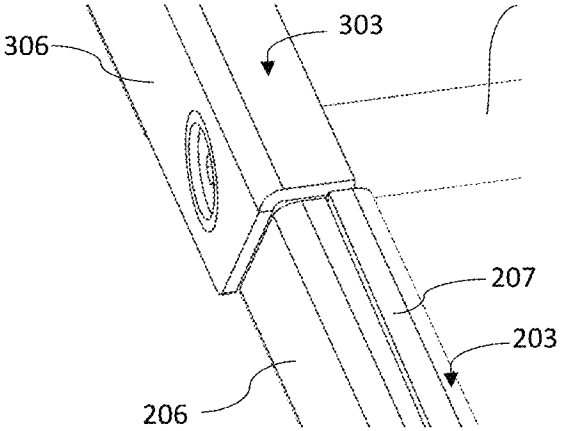
FIG. 13 is another perspective view of components of the folding chair in accordance with the present invention, and showing such components in a folded orientation.

Referring to FIGS. 13, 14 and 15, an outwardly disposed face of the distal end 306 of the first arm 302 is preferably offset from the corresponding outwardly disposed face of the distal upper end 206 of the first leg 202 (see FIG. 13). Note that the distal end 310 of the second arm 304 is similarly configured to be offset from the corresponding outwardly disposed face of the distal upper end 212 of the second leg 204. Thus, as the seat 10 is reconfigured from its folded orientation O2 to its deployed orientation O1, the distal upper ends 206, 212 of the first and second legs 202, 204 are permitted to slide against or next to corresponding inwardly disposed surfaces of the distal ends 306, 310 of the first and second arms 302, 304, e.g. in a scissor-like fashion. In this way, the overall length requirements for the first and second arms 302, 304 and/or the first and second legs 202, 204 may be minimized or reduced while still permitting pivotal movement of the seat assembly 300 relative to the rear leg assembly 200. In particular, the offset allows the chair 10 to have a shorter overall length when disposed in its folded orientation O2 than it otherwise would if lacking such offset, given additional length of the components would be necessary to accommodate the pivotal movement. In addition, the need for additional linkages that may otherwise be required for such pivotal movement is eliminated. Further, the offset configuration allows for a seat panel (described in further detail below) having a "waterfall edge" extending outwardly beyond the rod 320.

The first leg 202 preferably includes a ridge 207 extending outwardly from an upper surface 203 thereof. The second leg 204 is similarly configured to include a ridge extending outwardly from an upper surface thereof. When the chair 10 is in its folded orientation O2, the ridges 207 engages the upper surfaces 303 of the distal ends 306, 310 of the first and second arms 302, 304 (FIG. 13), thereby acting as mechanical stops of further pivotal movement of the seat assembly 300 relative to the rear leg assembly 200 in the rotational direction beyond the folded orientation O2 (e.g., restricting "hyper-extension" of the seat assembly 300 relative to the rear leg assembly 200). In addition, the ridges 207 provide additionally rigidity to the rear leg assembly 200, thereby enhancing structural integrity thereof. In a preferred embodiment, the ridges 207 are substantially coplanar with the upper surfaces 303 of the first and second arms 302, 304.

With continued reference to FIGS. 13, 14 and 15, the first arm 302 includes one or more seat fastening bracket(s) 325 and a pivot tab 327 coupled to and/or extending outwardly from an inwardly disposed face of the distal end 306 of the first arm 302 (FIG. 14). The second arm 304 is similarly configured to include one or more seat fastening bracket(s) 325 and a pivot tab 327 coupled to and/or extending outwardly from an inwardly disposed face of the distal end 310 of the second arm 304. When the chair 10 is disposed in its folded orientation O2, the pivot tab 327 is spaced from a corresponding contact surface 209 of the distal upper end 206 of the first leg 202. Thus, another pivot tab 327 provided on the distal upper end 310 of the second arm 304, which is spaced from a corresponding contact surface thereon.

As the chair 10 is reconfigured from its folded orientation O2 to its deployed orientation O1, the distal upper ends 206, 212 of the first and second legs 202, 204 are permitted to slide against or next to the corresponding distal ends 306, 310 of the first and second arms 302, 304 due to the offset configuration of the first and second arms 302, 304 relative to the first and second legs 202, 204, respectively, as described above (FIG. 13). In addition, an outer face 329 of the pivot tab 327 moves toward the contact surface 209 of the distal upper end 206 of the first leg 202 (and an outer face of another pivot tab 327 moves toward a corresponding contact surface of the distal upper end 210 of the second leg 204) due to the pivotal movement thereof (FIG. 14), until the outer face 329 engages the contact surfaces 209 when the chair 10 is disposed in its fully deployed orientation O1 (FIG. 15).

Thus, the pivot tabs 327 act as mechanical stops of further pivotal movement of the seat assembly 300 relative to the rear leg assembly 200 in the other rotational direction beyond the deployed orientation O1. In addition, further linear movement of the side portions 308, 312 of the first and second arms 302, 304 beyond a given point is restricted when pins 316, 318 reach the lower ends of the corresponding slots 118, 120. Thus, the length and position of the slots 118, 120 on the inner rail members 102, 104 act as another mechanical stop to prevent further movement of the seat assembly 300 relative to the front leg assembly 100 in a downward direction beyond the deployed orientation O1. In this way, the seat assembly 300 is securely retained and supported by the front leg assembly 100 and the rear leg assembly 200 in the deployed orientation O1. The possibility that the seat assembly 300 will sag or tilt from extended use and/or weight disposed thereon is essentially eliminated.

Figure 17:
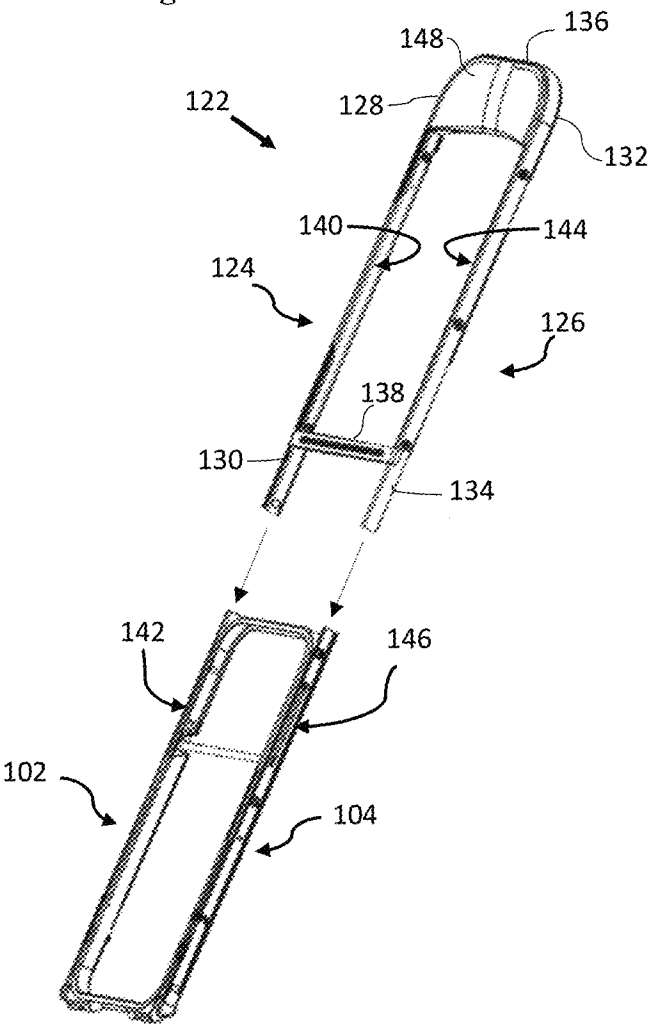
FIG. 17 is a perspective view of components of the folding chair in accordance with the present invention, and showing the outer frame and inner rail members of the front leg assembly aligned and prior to slidable connection thereof.
Figure 16:
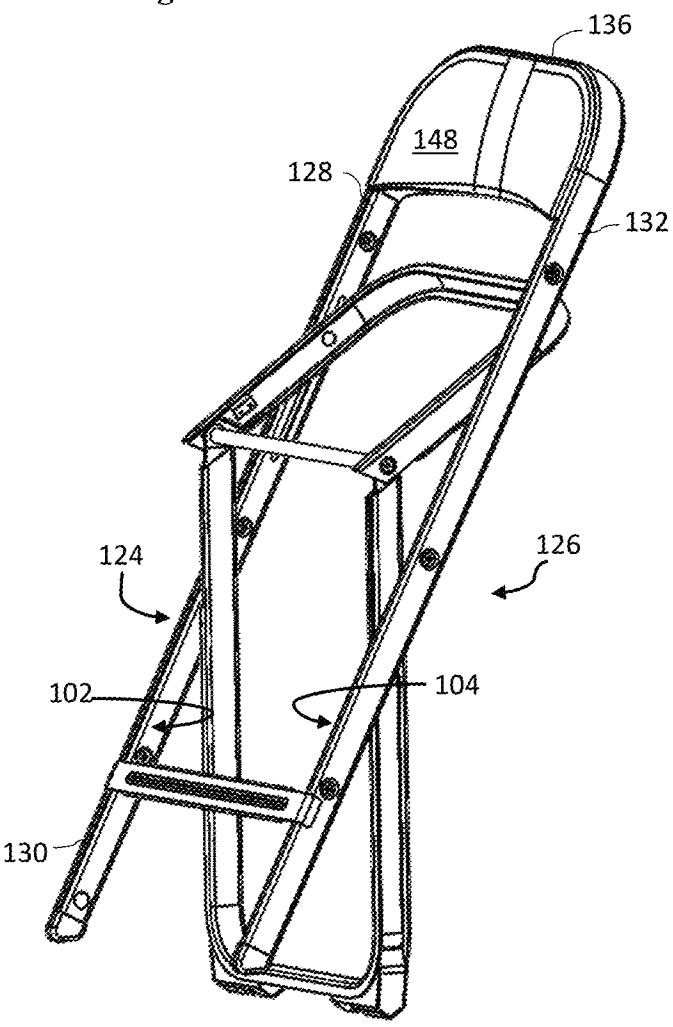
FIG. 16 is a front perspective view of components of the folding chair in accordance with the present invention, and showing such components in a partially deployed orientation.
Figure 18:
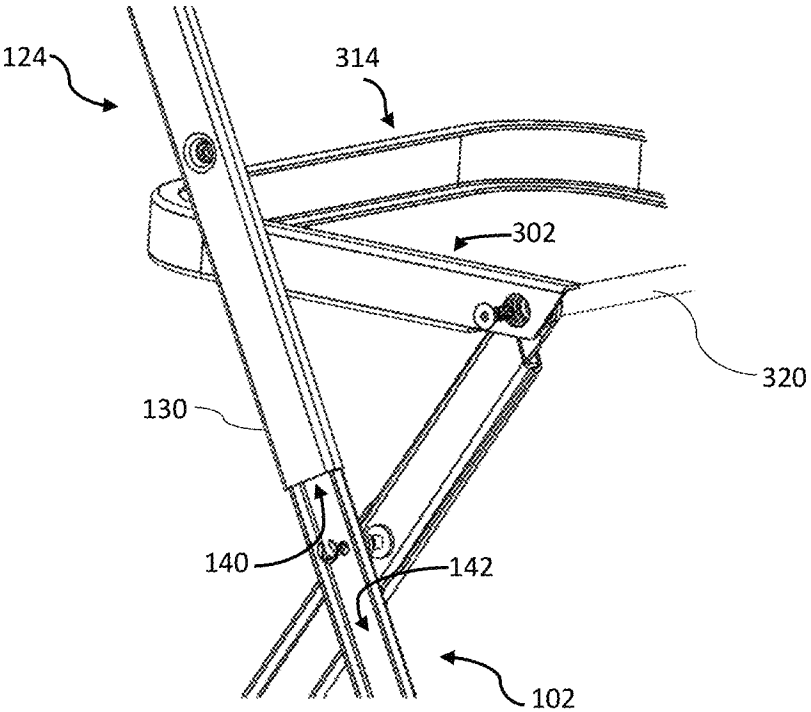
FIG. 18 is another front perspective view of components of the folding chair in accordance with the present invention.

Referring to FIGS. 16 and 17, the front leg assembly 100 also preferably includes an outer frame 122 including first and second cover members 124, 126 coupled to the first and second inner rail members 102, 104, respectively. The first cover member 124 includes an upper portion 128 and a lower distal portion 130, and the second cover member 126 includes an upper portion 132 and a lower distal portion 134. The outer frame 122 also preferably includes a central portion 136 coupled to and extending between the upper portions 128, 132 of the first and second cover members 124, 126. The first and second cover members 124, 126 and the central portion 136 of the outer frame 122 may collectively have a generally U-shaped configuration, as shown in FIG. 17. The outer frame 122 preferably includes a brace or crossbar 138 that is coupled to and extends between the lower distal portions 130, 134 of the first and second cover members 124, 126, which enhances structural integrity of the chair 10. Alternatively, or in addition, a crossbar may be coupled to and extend between the lower portions 110, 116 of the first and second inner rail members 102, 104. In one implementation, the first cover member 124 defines or comprises an inwardly facing channel 140 that is slidably received over an outwardly facing surface 142 of the first inner rail member 102, as shown in FIGS. 17 and 18. Similarly, the second cover member 126 defines a channel 144 that is slidably received over an outwardly facing surface 146 of the second inner rail member 104.

Referring again to FIGS. 1-4, the seat assembly 300 includes a seat panel 326 that is secured to and extends between the first and second arms 302, 304 and/or the central portion 314 of the seat assembly 300. Thus, the seat panel 326, and any weight placed thereon (e.g., an individual sitting in the chair 10) is supported by first and second arms 302, 304 and the central portion 314. The seat panel 326 preferably includes a "waterfall edge" or front edge portion 328 extending outwardly from the second pivot axis X2 (see FIG. 8), and thus extending outwardly from the distal ends 306, 310 of the first and second arms 302, 304 and from the rod 320 (see FIG. 4). The outwardly extending front edge portion 328 of the seat panel 326 provides a comfortable sitting surface, given a user's legs do not engage the underlying first and second arms 302, 304 or rod 320 of the seat assembly 300 when the user is sitting in the chair 10. The seat panel 326 may include reinforcing ribs or support struts extending from an underside thereof, as shown in FIG. 4. In some implementations, the seat panel 326 includes a cushioned or padded upwardly disposed surface for additional comfort to the user during use.

With continued reference to FIGS. 1-4, the chair 10 also preferably includes a back panel 148 configured to support a user's back, as well known in the art. In one embodiment, the back panel 148 is secured to and extends between the upper portions 128, 132 of the first and second cover members 124, 126, as shown in FIGS. 16 and 17. The back panel 148 is also preferably extending and coupled to the central portion 136.

The chair 10 preferably includes feet or glides so that the chair 10 may be easily moved on a support surface without damaging or otherwise scratching the support surface. For example, front glides 111, 117 may be secured to and extend outwardly from the lower portions 110, 116 of the first and second inner rail members 102, 104, respectively, of the front leg assembly 100, as shown in FIGS. 1, 2 and 5. Rear glides 211, 217 may be secured to and extend outwardly from the lower end portions 210, 216 of the first and second legs 202, 204, respectively, of the rear leg assembly 200, as shown in FIGS. 1-5. Glides 111, 117, 211, 217 are preferably formed from a polymer or other suitable material that slides on support surfaces (e.g., wood, tile, concrete floors, etc.) without damaging or scratching the support surface. At the same time, the glides 111, 117, 211, 217 provide some frictional resistance so that the chair 10 generally remains in a desired position on the support surface unless a threshold amount of force is applied sufficient to move the chair 10.

Figure 20:
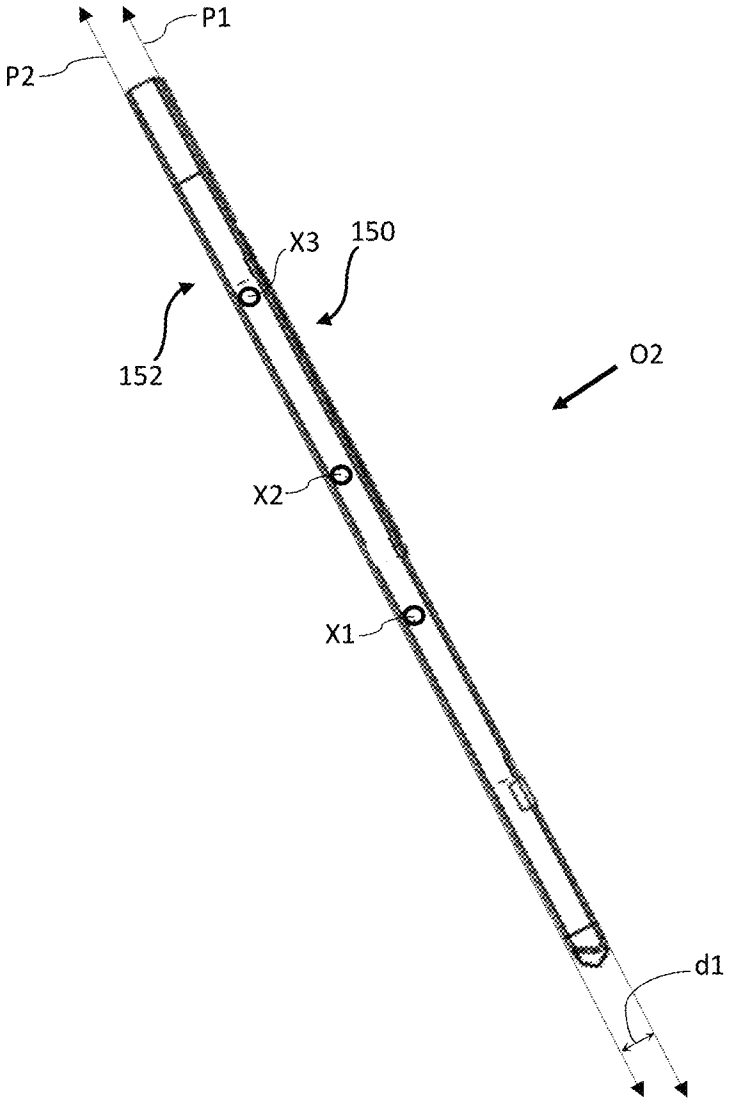
FIG. 20 is a side view of the folding chair in accordance with the present invention, and showing the chair in a folded orientation.
Figure 19:
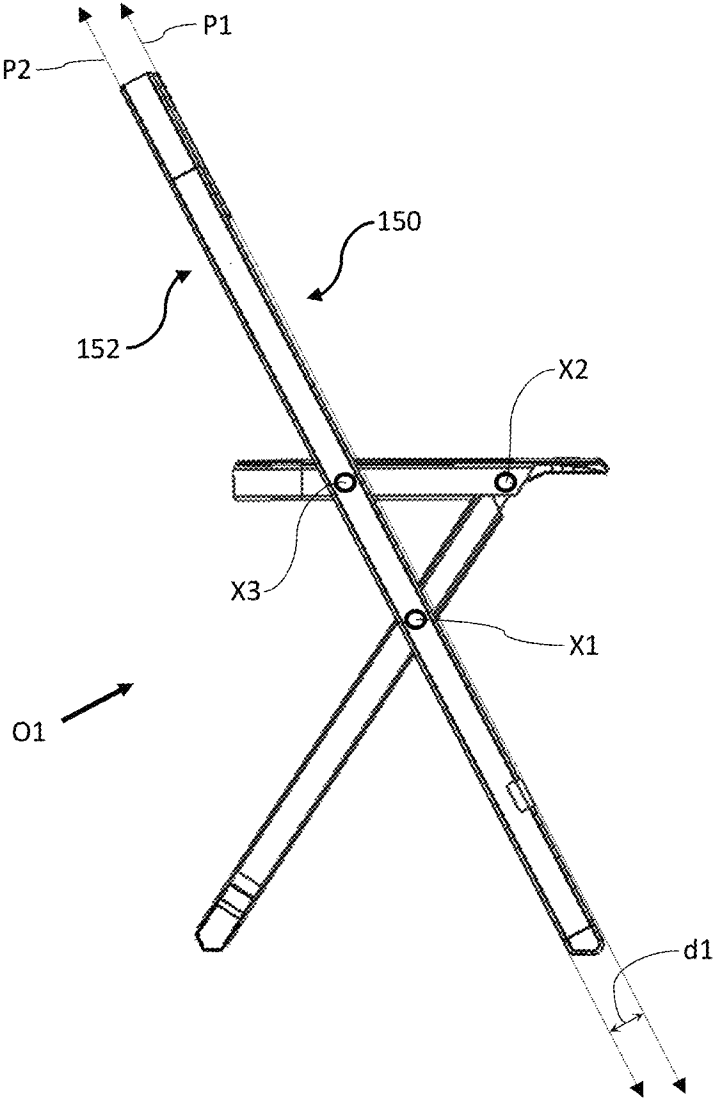
FIG. 19 is a side view of the folding chair in accordance with the present invention, and showing the chair in a deployed orientation.

Referring to FIGS. 19 and 20, the front leg assembly 100 defines a first side or face 150 substantially disposed on a first plane P1, and an opposite second side or face 152 substantially disposed on a second plane P2. The first plane P1 is spaced from and parallel to the second plane P2 by a distance dl. The second pivot axis X2 is disposed outwardly from the first plane P1 when the folding chair 10 is disposed in its deployed orientation O1, as shown in FIG. 19. As the chair 20 is reconfigured from its deployed orientation O1 to its folded orientation O2, the second pivot axis X2 moves inwardly toward the first plane P1. When the chair 10 is disposed in its fully folded orientation O2, the second pivot axis X2 is preferably disposed in between the first plane P1 and the second plane P2 (and thus in between the first face 150 and the second face 152), as shown in FIG. 20. In addition, the second pivot axis X2 is preferably parallel to and substantially coplanar with the first pivot axis X1 (as well as the third pivot axis X3) when the chair 20 is disposed in its folded orientation O2.

In accordance with disclosed embodiments, the folding chair 10 is extremely compact and thin when disposed in its folded orientation O2, as shown in FIGS. 3, 4 and 20. For example, in some implementations the folding chair 10 has a thickness as defined by distance dl (see FIG. 20) of between about 1.0 inch and about 2.5 inch, more preferably between about 1.5 inch and about 1.75 inch. However, it will be readily understood to one of skill in the art that the particular dimensions of the overall chair 10, and/or of the particular components thereof (e.g., such as the front leg assembly 100 including the back panel 148, the rear leg assembly 200, and/or the seat assembly 300 including the seat panel 326) may vary depending on desired specifications and application. For example, the chair 10, and/or of the seat panel 326 of the seat assembly 300, may have a width of between about 15 inches and about 25 inches, more preferably between about 15 inches and about 20 inches.

In addition, the components of the folding chair 10 may be formed from various materials, including but not limited to metal, polymer, wood, wood composite, and other natural and synthetic materials. In some implementations, the back panel 148 and/or seat panel 326 are formed from a polymer material (e.g., such as polypropylene, polyvinyl chloride, or other suitable material) and other components are formed from metal (e.g., such as stainless steel, or other sheet metal). Due to the configuration of the components, sheet metal (or other material) having a relatively small thickness may be utilized and still maintain sufficient structural integrity under typical weight capacity requirements for folding chairs (e.g., weight capacity up to about 250 pounds, or about 350 pounds, or about 400 pounds). For example, components of the front leg assembly 100, the rear leg assembly 200 and/or the seat assembly 300 may be formed from 12, 14 or 16 gauge sheet metal. However, it would be readily understood that overall weight capacity may be selectively determined based on material selection, metal gauge, and/or by providing additional support ribs or struts, as known in the art. Further, the components may be painted or otherwise coated (e.g., such as via powder coating or another finish layer) and/or include other surface treatments, as well known in the art.

As noted above, the chair 10 folds to a substantially flat rectangular configuration defined by opposing faces 150, 152. As such, the chair 10 is compact and may be readily stacked and/or abutted with other chairs 10 for storage. The folding chair 10 may be easily and quickly reconfigured from its deployed orientation O2 (FIGS. 1 and 2) to its folded orientation O2 (FIGS. 3 and 4). For example, the crossbeam 218 of the rear leg assembly 200 may be lifted upwardly (relative to a support surface) so that the chair 10 is inverted with the central portion 136 and back panel 148 disposed downwardly. Thus, the chair 10 may be flipped upside down by lifting the crossbeam 218 upwardly. With the crossbeam 218 in an upward or raised position relative to the seat assembly 300, the pins 316, 318 slide downwardly in the slots 118, 120 of the front leg assembly 100 due to gravitation forces. Thus, the third pivot axis X3 moves linearly along the longitudinal axes A1, A2 of the first and second inner rail members 102, 104, and away from the first pivot axis X1, as described above. The seat assembly 300 thereby slides downwardly, so that the rear leg assembly 200 and the seat assembly 300 have a generally rectangular configuration, until the second pivot axis X2 is coplanar with the first pivot axis X1. In addition, the front leg assembly 100 pivots about the first pivot axis X1, and/or the rear leg assembly 200 and front leg assembly 100 pivot inwardly toward each other due to gravitational forces as well as the sliding movement of the seat assembly 300 upon the front leg assembly 100. In this way, the folding chair 10 may be readily reconfigured from its deployed orientation O1 to its folded orientation O2 (FIGS. 3 and 4). The folded chair 10 may then be hung (e.g., by crossbeam 218 and/or the crossbar 138) or stacked for storage.

While the invention has been described in connection with exemplary embodiments thereof, it will be understood that it is capable of further modifications. In addition, features of one embodiment may be utilized in another embodiment. Thus, this application is intended to cover any variations, uses, or adaptations of the invention following, in general, the principles of the invention and including such departures from the present disclosure as come within known or customary practice within the art to which the invention pertains and as may be applied to the features hereinbefore set forth.

What is claimed is:

1. A folding chair comprising:

a front leg assembly comprising spaced first and second inner rail members, each of said first and second inner rail members having a longitudinal axis, and an outer frame comprising spaced first and second cover members coupled to said first and second inner rail members, respectively;

a rear leg assembly comprising spaced first and second legs, said first and second legs comprising central portions pivotally connected to said first and second inner rail members, respectively, about a first pivot axis perpendicular to and substantially coplanar with said longitudinal axes of said first and second inner rail members; and a seat assembly comprising spaced first and second arms, said first and second arms comprising distal ends pivotally connected to upper ends of said first and second legs, respectively, about a second pivot axis, and said first and second arms comprising central portions pivotally connected to said first and second inner rails, respectively, about a third pivot axis parallel to and substantially coplanar with said first pivot axis, said third pivot axis moveable along said longitudinal axes of said first and second inner rail members and toward and away from said first pivot axis as the folding chair is reconfigured between a deployed orientation and a folded orientation.

2. The folding chair of claim 1, wherein said second pivot axis is parallel to and substantially coplanar with said first pivot axis when the folding chair is disposed in said folded orientation.

3. The folding chair of claim 1, wherein said spaced first and second cover members comprise channels slidably received over said first and second inner rail members, respectively.

4. The folding chair of claim 1, wherein said outer frame further comprises a back panel coupled to and extending between upper end portions of said first and second cover members.

5. The folding chair of claim 1, wherein said outer frame has a generally U-shaped configuration.

6. The folding chair of claim 1, wherein said outer frame defines a front face and an opposite rear face of the folding chair, wherein said second pivot axis is disposed outwardly from said front face when the folding chair is disposed in said deployed orientation.

7. The folding chair of claim 6, wherein said second pivot axis is disposed in between said front face and said rear face when the folding chair is disposed in said folded orientation.

8. The folding chair of claim 1, further comprising a brace coupled to and extending between lower portions of said first and second cover members.

9. The folding chair of claim 1, further comprising a brace coupled to and extending between lower portions of said first and second inner rail members.

10. The folding chair of claim 1, wherein:

each of said first and second inner rail members comprises a slot disposed in an upper portion thereof and extending substantially parallel to said longitudinal axes of said first and second inner rail members; and each of said first and second arms of said seat assembly comprises an engagement member extending outwardly from said central portion thereof and received in and movable along a corresponding one of said slots as the folding chair is reconfigured between said deployed orientation and said folded orientation.

11. The folding chair of claim 1, wherein said seat assembly has a generally U-shaped configuration.

12. The folding chair of claim 1, further comprising a rod coupled to and extending between said first and second arms of said seat assembly.

13. The folding chair of claim 12, wherein said rod has a longitudinal axis axially aligned with said second pivot axis.

14. The folding chair of claim 1, further comprising a seat panel coupled to and extending between said first and second arms of said seat assembly.

15. The folding chair of claim 1, wherein said rear leg assembly and said seat assembly have a generally rectangular configuration when the folding chair is disposed in said folded orientation.

16. The folding chair of claim 1, wherein each of said distal ends of said first and second arms overlaps an outwardly disposed surface on a corresponding one of said upper ends of said first and second legs, respectively, when said folding chair is disposed in said folded orientation.

17. A folding chair comprising:

a front leg assembly comprising spaced first and second inner rail members, each of said first and second inner rail members having a longitudinal axis;

a rear leg assembly comprising spaced first and second legs, said first and second legs comprising central portions pivotally connected to said first and second inner rail members, respectively, about a first pivot axis perpendicular to and substantially coplanar with said longitudinal axes of said first and second inner rail members; and a seat assembly comprising spaced first and second arms, said first and second arms comprising distal ends pivotally connected to upper ends of said first and second legs, respectively, about a second pivot axis, and said first and second arms comprising central portions pivotally connected to said first and second inner rails, respectively, about a third pivot axis parallel to and substantially coplanar with said first pivot axis, said third pivot axis moveable along said longitudinal axes of said first and second inner rail members and toward and away from said first pivot axis as the folding chair is reconfigured between a deployed orientation and a folded orientation, wherein each of said distal ends of said first and second arms comprises a pivot tab that engages a contact surface on a corresponding one of said upper ends of said first and second legs, respectively, when said folding chair is disposed in said folded orientation.

18. The folding chair of claim 17, wherein the front leg assembly further comprises an outer frame comprising spaced first and second cover members coupled to said first and second inner rail members, respectively.

19. A method of assembling a folding chair, comprising the steps of:

providing a pair of spaced inner rail members each having a longitudinal axis;

providing a seat assembly pivotally connected to a pair of rear legs;

pivotally connecting the rear legs to the inner rail members about a first pivot axis, wherein the seat assembly is pivotally connected to the rear legs about a second pivot axis spaced from the first pivot axis;

pivotally and slidably connecting the seat assembly to the inner rail members about a third pivot axis, wherein the third pivot axis is coplanar with and movable toward and away from the first pivot axis; and coupling a pair of cover members to outwardly disposed surfaces of the inner rail members.

20. The method of claim 19, wherein the cover members are slidably received over inner rail members along the longitudinal axes thereof.

* * * * *